United States Patent [19]

Zylbert

[11] Patent Number: 4,494,471

[45] Date of Patent: Jan. 22, 1985

[54] BUTTONHOLE FOOT AND SHANK ASSEMBLY

[75] Inventor: Thaddeus J. Zylbert, Morris Plains, N.J.

[73] Assignee: The Singer Company, Stamford, Conn.

[21] Appl. No.: 581,832

[22] Filed: Feb. 21, 1984

[51] Int. Cl.[3] ..... D05B 29/08

[52] U.S. Cl. ..... 112/235; 112/158 B

[58] Field of Search ..... 112/240, 235, 158 B, 112/151, 140

[56] References Cited

U.S. PATENT DOCUMENTS

| | | | |
|---|---|---|---|
| 246,907 | 9/1881 | Pitman . | |
| 1,300,928 | 4/1919 | Chalman . | |
| 1,314,820 | 9/1919 | Lombardo et al. . | |
| 2,184,604 | 12/1939 | Ray | 112/235 |
| 2,804,037 | 8/1957 | Connors | 112/235 |
| 2,977,913 | 4/1961 | Schenkengel . | |
| 3,511,201 | 5/1970 | Howell | 112/240 |
| 3,795,209 | 3/1974 | Smith . | |

FOREIGN PATENT DOCUMENTS

| | | |
|---|---|---|
| 5347941 | 9/1976 | Japan . |
| 554748 | 1/1978 | Japan . |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A presser foot with a grooved sole plate for use in the formation of buttonholes on a sewing machine is pivotally mounted on a screw with which the foot can be moved laterally relative to the shank to position a groove dividing ridge with respect to a sewing needle.

6 Claims, 5 Drawing Figures

BUTTONHOLE FOOT AND SHANK ASSEMBLY

DESCRIPTION

Background of the Invention

1. Field of the Invention

The invention relates to presser feet for sewing machine use.

2. Description of the Prior Art

Straight stitches are normally formed on a sewing machine with sufficient thread tension to produce a fairly tight line of stitches in which the individual loops do not rise significantly above the level of a fabric. Straight line stitches therefor do not normally interfere with the movement of fabric under a presser foot by a feed dog during a sewing operation. However, when zig-zag stitches are formed, as during sewing of buttonholes, less thread tension is employed to prevent the fabric from puckering, and raised stitches, which tend to divert the movement of fabric under a presser foot from a straight line course in the direction of feed dog movement result. A presser foot for use in the formation of buttonholes may be provided with longitudinal grooves to receive the raised zig zag loops and guide movement of a work piece. However, it has been found that tapered buttonholes are likely to be produced even with the grooved foot because of maufacturing and adjustment variations in machines causing stitches for right and left buttonhole legs to be formed assymetrically with respect to the grooves in the foot, and therefor out of alignment with the grooves.

It is a prime object of the present invention to provide for the formation of parallel lines of buttonhole stitches on a sewing machine.

It is another object of the invention to provide a buttonhole presser foot and shank assembly for a sewing machine enabling an operator to position the foot relative to a sewing needle in a manner assuring the formation of parallel lines of stitches for the right and left legs of a buttonhole.

Other objects and advantages of the invention will become apparent during a reading of the specification taken in connection with the accompanying drawings.

SUMMARY OF THE INVENTION

A presser foot according to the invention for use in the formation of buttonholes includes a sole plate with a laterally extending opening for a needle to pass through and form zig zag stitches for right and left buttonhole legs. The foot further includes a longitudinal groove in the underside of the sole plate on each side of a bisecting ridge for loops of the zig zag stitches in the right and left buttonhole legs respectively to move through during buttonhole stitching. The foot is pivotally supported in a presser foot shank on a screw with which the foot can be moved relative to the shank to position the groove dividing ridge on the underside of the sole plate with respect to the needle of the machine.

DESCRIPTION OF THE PREFERRED EMBODIMENT

Figure 1:
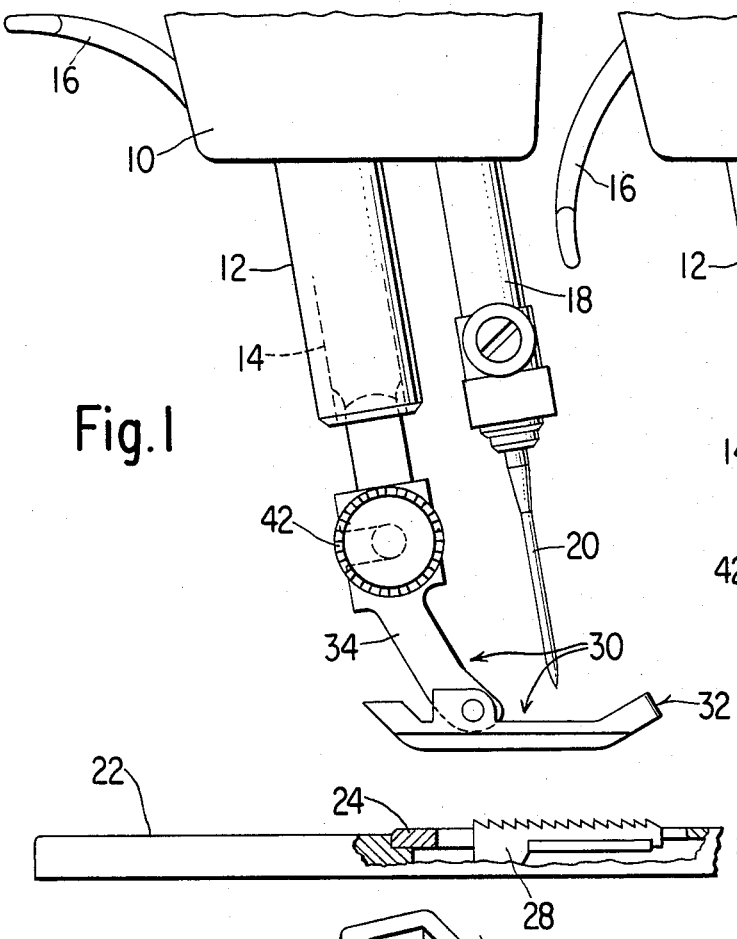
FIG. 1 is a side elevational view of a fragment of a sewing machine showing a presser foot and shank assembly according to the invention on a released presser bar.
Figure 2:
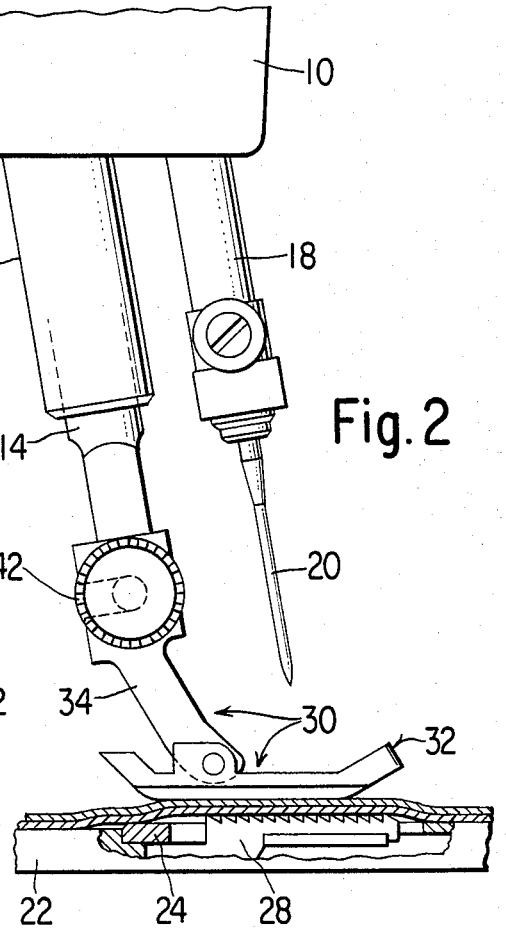
FIG. 2 is a view similar to FIG. 1 with the presser bar in a lowered position.
Figure 3:
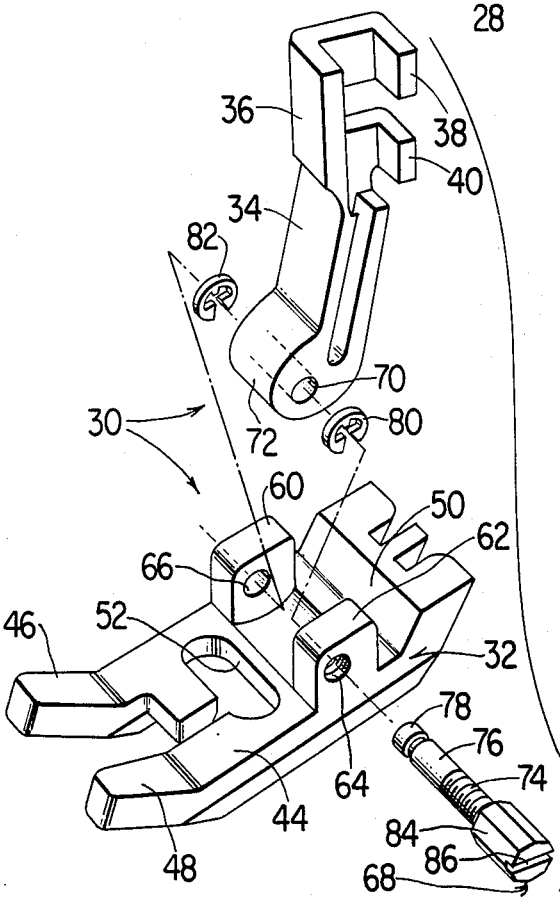
FIG. 3 is an enlarged disassembled perspective view showing the construction of the invention.
Figure 4:
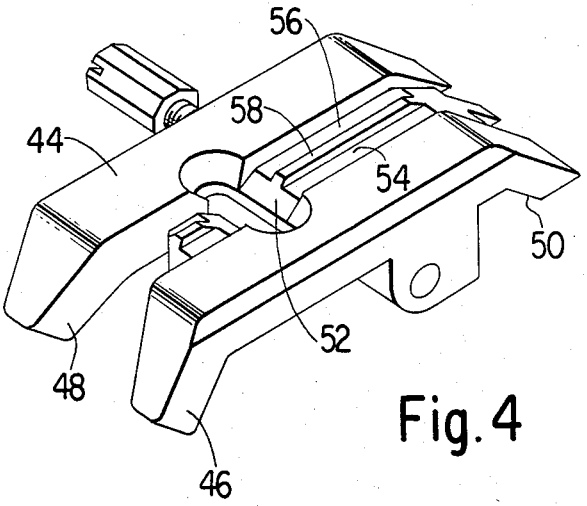
FIG. 4 is a bottom perspective view of the presser foot.
Figure 5:
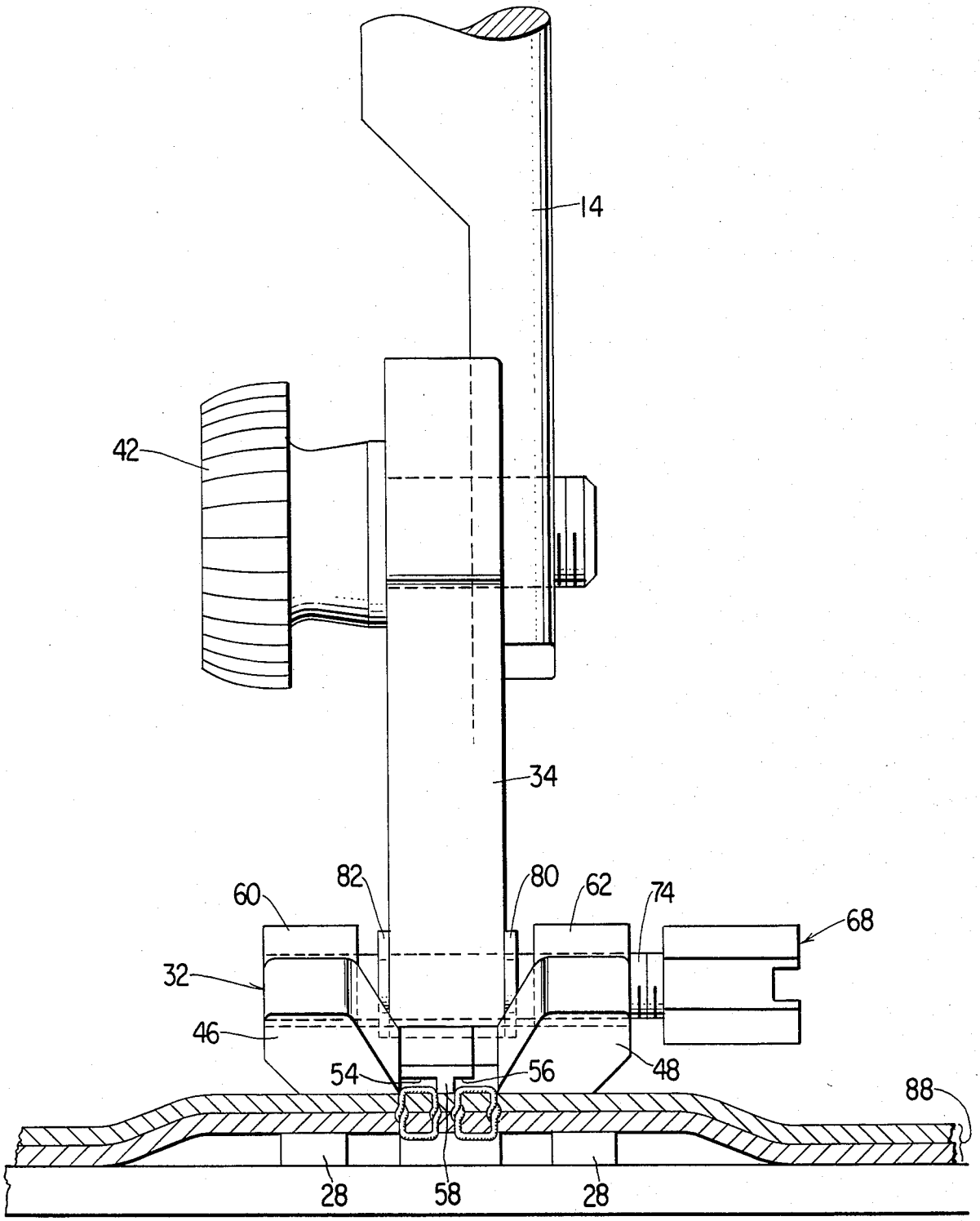
FIG. 5 is an enlarged fragmentary front elevational view showing the presser foot and shank assembly according to the invention.

Referring to the drawings, reference character 10 designates the head end portion of a sewing machine bracket arm. A bushing 12 is secured in the head end portion 10 and a presser bar 14 is slidable endwise in the bushing. The presser bar, as is conventional, is provided with a spring (not shown) to bias it downwardly. However, the presser bar may be raised and lowered at will by a presser lifting lever 16 carried in the bracket arm. A needle bar 18 carrying a needle 20 for the formation of stitches is endwise reciprocable in the bracket arm, and may be oriented during the operation of the machine, as by mechanism shown for example, U.S. Pat. No. 3,670,676 of T. Sawada for "Control Means for Buttonhole Zig Zag Sewing Machine" issued June 20, 1972 to provide for the formation of buttonhole stitches. The sewing machine frame includes a work supporting bed 22 beneath the bracket arm. The bed carries a throat plate 24 that is formed with slots through which a feed dog 28 of a conventional sewing machine work feed mechanism is operative. An assembly 30 according to the invention, including a presser foot 32 and a shank 34 is shown affixed to the presser bar.

Shank 34 is formed at the upper end with a presser bar accommodating seat defined at one side by an outturned tab 36 and at the other side by outturned bifurcations 38 and 40. The presser foot shank is secured to the presser bar by means of a shouldered clamp screw 42 which passes between the bifurcations and is threaded into the presser bar 14.

Presser foot 32 includes a sole plate 44 with upturned end toes 46 and 48, and an upturned heel 50. The sole plate is formed with an elongate laterally extending opening 52 through which needle 20 may pass to form zig zag buttonhole stitches. Longitudinal grooves 54 and 56 intersecting the opening 52 are formed in the underside of the sole plate on opposites of a bisecting ridge 58 for the loops of buttonhole stitches in right and left buttonhole legs to move through during the formation of a buttonhole.

The presser foot 32 includes a pair of laterally spaced ears 60 and 62 which extend upwardly from sole plate 44. Ear 62 includes a threaded opening 64, and ear 60 includes an unthreaded opening 66 in alignment with opening 64. The presser foot is pivotally mounted on shank 34, with a screw 68 extending through opening 64 in ear 62, and into opening 66 in ear 60, as well as through an unthreaded opening 70 in a boss 72 formed in the lower end of the shank and disposed between the ears. Screw 68 includes a threaded portion 74, and unthreaded portions 76 and 78. In the assembly, the threaded portion 74 is in threaded engagement with ear 62 in threaded opening 64, and the unthreaded portions 76 and 78 extend through opening 70 and into opening 66, respectively. Resilient C-clamps 80 and 82 grip the screw, and bracket boss 72 on shank 34 to prevent the screw from being moved axially relative to the shank. Screw 68 includes a head end portion 84 enabling an operator to turn the screw with his fingers, and a slot 86 in the head end portion to further facilitate turning with a screw driver. When the screw is turned, foot 32 is caused to move laterally relative to shank 34 in one direction or the other depending upon whether the screw is turned clockwise or counterclockwise.

Presser foot 32 is intended for use on conventional machines adapted to sew buttonholes in a two step operation, and/or a four step operation. For either type of operation, the presser foot ridge 58 is aligned with a buttonhole center line marking in a test work piece before any buttonhole stitches are sewn. In a two step operation, the buttonhole is first stitched around the top end and down the left side thereof with zig zag stitches, after which the buttonhole is stitched around the bottom end and up the right side with zig zag stitches. In a four step operation, bar tack stitches are first formed for the top end of the buttonhole after which zig zag stitches are formed down the left side of the buttonhole. The work is then pivoted 180° with the needle in the work. Bar tack stitches are formed in the bottom end of the buttonhole and finally zig zag stitches are formed down the remaining side of the buttonhole. In either case, if zig zag stitches for right and left buttonhole legs have formed assymetrically with respect to ridge 58 by needle 20, and therefor out of alignment with grooves 54 and 56, movement of the work piece under the presser foot will not have been guided by the loops of these stitches, and the buttonhole legs may taper. However, an operator having observed a lack of parallelism can correct the condition by turning screw 68 to move foot 32 relative to the needle and align grooves 54 and 56 with the stitches. When it has been determined by trail and error adjustment of foot 32 with screw 68 that parallel legs are being sewn in the test work piece, buttonholes may be sewn in the fabric 88 for which they were originally intended.

It is to be understood that the present disclosure relates to a preferred embodiment of the invention which is for purposes of illustration only, and that various changes and modifications may be made therein without departing from the spirit and scope of the invention as defined in the appended claims.

I claim:

1. In combination: a presser foot for use in the formation of buttonholes on a zig zag sewing machine, said presser foot including a sole plate with a laterally extending opening for the needle of the machine to pass through and form zig zag stitches for right and left legs of a buttonhole, the underside of the sole plate including a longitudinal groove on each side of a dividing ridge for loops of zig zag stitches in right and left buttonhole legs, respectively, to pass through during the formation of a buttonhole; a presser bar shank securable in the machine; and means supporting the foot for pivotal movement on the presser bar shank, said means including an adjustable screw with which the foot can be moved laterally relative to the shank to position the dividing ridge on the underside of the sole plate with respect to the needle.

2. The combination of claim 2 in which said screw has a threaded connection with the foot and extends through an end portion of the presser foot shank wherein axial movement of the screw is prevented by shank bracketing members in axially affixed positions on the screw.

3. The combination of claim 2 wherein the screw has said threaded connection with the foot in an upstanding ear on the sole plate, an end portion of the screw is supported in another upstanding ear on the sole plate, and the said end portion of the presser foot shank is between the two upstanding ears on the sole plate.

4. The combination of claim 3 wherein said end portion of the screw is rotatably and slidably supported in the said another upstanding ear on the sole plate without being threaded therein.

5. The combination of claim 3 including an enlarged head end portion on the screw to facilitate the turning thereof.

6. The combination of claim 5 wherein the enlarged head end portion of the screw is slotted to receive the blade of a screw driver.

* * * * *